United States Patent [19]

Cocks

[11] 4,028,014

[45] June 7, 1977

[54] REVERSING MEANS FOR DOUBLE-ACTING FLUID PUMP

[76] Inventor: Eric H. Cocks, 4100 Galt Ocean Drive, Fort Lauderdale, Fla. 33308

[22] Filed: June 18, 1975

[21] Appl. No.: 587,977

[52] U.S. Cl. ..... 417/403

[51] Int. Cl.[2] ..... F04B 9/10

[58] Field of Search ..... 417/264; 91/275

[56] References Cited

UNITED STATES PATENTS

| | | | |
|---|---|---|---|
| 2,612,951 | 10/1952 | Palmleaf | 91/275 X |
| 2,658,485 | 11/1953 | Dreyer | 417/264 X |
| 2,755,966 | 7/1956 | Lindars | 91/275 X |
| 2,772,664 | 12/1956 | Jones et al. | 91/275 X |

FOREIGN PATENTS OR APPLICATIONS

| | | | |
|---|---|---|---|
| 1,342,507 | 12/1962 | France | 417/403 |

*Primary Examiner*—William L. Freeh

[57] ABSTRACT

A double-acting, piston-type fluid pump is reversed in direction by solenoid valves actuated by electrical switches located at each end of the piston movement.

1 Claim, 9 Drawing Figures

REVERSING MEANS FOR DOUBLE-ACTING FLUID PUMP

BACKGROUND OF THE INVENTION

This invention relates to apparatus for melting and dispensing thermoplastic materials, and more particularly to the control of the fluid pump utilized in such apparatus.

The majority of pumps used in hot-melt plastic dispensing units are similar to the pumps used for painting and other fluid dispensing applications in which a large air piston is connected to a small fluid piston to obtain a multiple ratio between the amount of air pressure required and the amount of fluid pressure developed. Some systems utilize single-acting pumps, that is, pumps which make use of only one-half of the piston movement for pumping action. Other systems utilize double-acting pumps which make use of both halves of the piston stroke to accomplish pumping action.

It will be appreciated that the double-acting pump can more closely approach a steady flow of fluid material as compared to the single-acting pump in which no fluid is pumped for half of the piston stroke. It has become a problem, however, even in double-acting pumps, to maintain a steady flow of fluid material because of the piston action at the end points of piston travel when the pump reverses its direction of stroke.

It has been conventional in the art for double-acting pumps used in hot-melt and painting applications to utilize a mechanical toggle-type of switching system for reversing the pump. These mechanical toggles present manufacturing difficulties and also operational problems. In operation the volume and pressure of the fluid at the applicator head is noticably affected when the double-acting piston pump reaches its points of reversal, at each end of the stroke. As the pump piston approaches one end of its travel and begins to activate the toggle switching mechanism, the piston is working against a pressure force which it did not have during the earlier part of its travel. This additional force requires a change in work produced at the outlet at this point of piston travel. As the piston continues to bear against the toggle switching mechanism and starts to move it, additional force is encountered by the piston, and, depending upon the force required to operate the toggle mechanism the piston will move somewhat slower. The resistance offered by the toggle is not uniform, but increases as the toggle approaches dead center and varies thereafter in inverse fashion from the dead center position to the end of stroke. The additional resistance force of the toggle acting against the piston produces a diminishing of pressure available for work from the time the piston first reaches the toggle will it has moved the toggle to cause reversal.

Conventional toggle mechanisms are relatively expensive to build and require careful machining, lapping of parts and additional detail for proper operation. The use of toggle mechanisms also results in a long pump because the additional length of the pump taken up for the toggle is not added to the stroke.

SUMMARY OF THE INVENTION

It is an object of this invention to provide a double-acting, piston-type, fluid pump which will maintain, as nearly as practicable, a constant and continuous reversing thrust output from the piston by producing positive and rapid reversal of the airflow operating the pump.

This object is realized by eliminating toggle switching mechanisms completely and utilizing a combination of solenoid valves and actuating switches which are operated without producing reactive forces which would affect and vary the piston operation.

An electrical switch is located at each end of the piston travel in a double-acting, piston-type, fluid pump to be actuated as the piston reaches the point of stroke where reversal is required. Each switch in turn controls a solenoid valve which regulate air flow to the end of the piston to produce a smooth and rapid reversal of stroke.

DESCRIPTION OF THE PREFERRED EMBODIMENT

Figure 1:
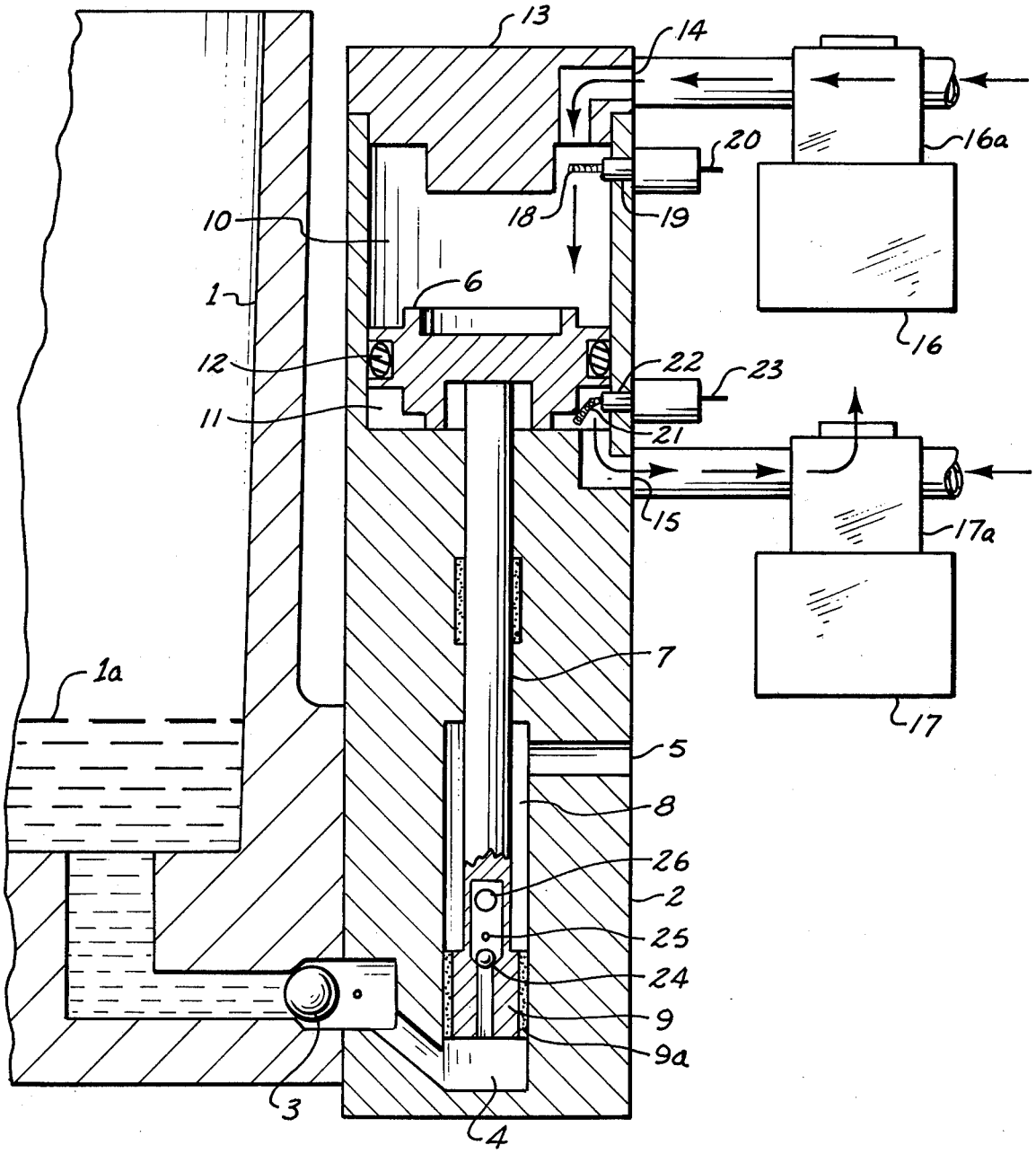
FIG. 1 is a cross-section detailed view in simplified form showing a double-acting, piston-type fluid pump with solenoid valves and actuating switches utilized in accordance with the principles of the invention.
Figure 2:
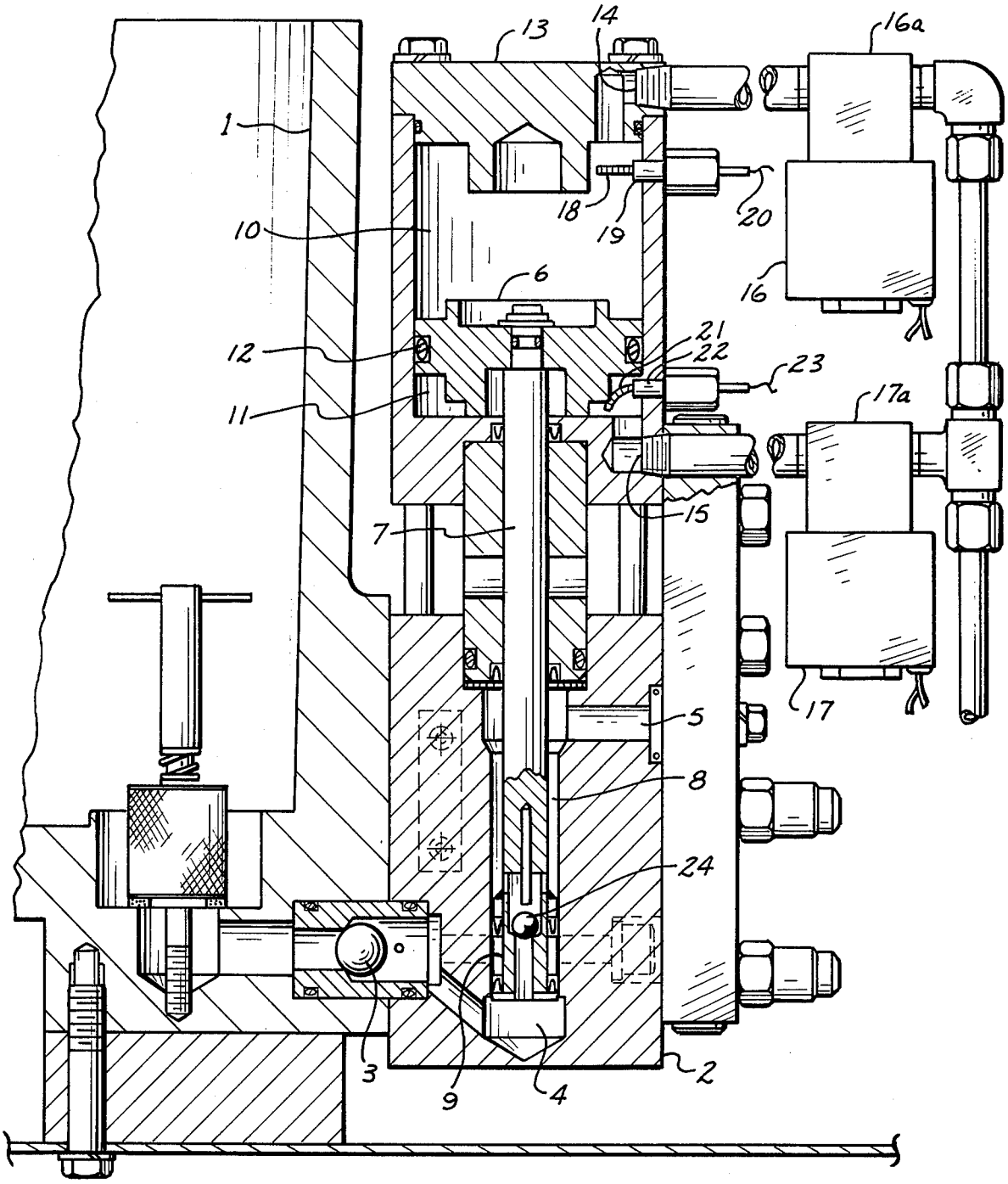
FIG. 2 is a cross-section detailed view in complete form of the system shown in FIG. 1.

The principles of operation of the invention will be understood more clearly by referring to FIGS. 1 and 2 which are detailed views in cross-section of the apparatus of the invention. The detail shown in FIG. 1 is simplified to permit the description to be followed more readily, while the detail of FIG. 2 is shown of the equipment as it is actually manufactured and utilized. It will be noted that packings, seals and other items are shown symbolically in FIG. 1, and that heating elements and other parts required for total operation are omitted.

A supply tank 1 contains a source of fluid 1*a* which passes through a check valve 3 into lower fluid cavity 4 of pump body 2. Pump body 2 is attached to supply tank 1. The action of the fluid pump forces the fluid out of the pump body 2 through port 5.

An air piston 6 is mounted in the upper portion of pump body 2 dividing the air chamber into upper air cavity 10 and lower air cavity 11. Piston rod 7 extends downwardly from air piston 6 through appropriate fluid seals into upper fluid cavity 8, and is attached to fluid piston 9. Fluid piston 9 has appropriate fluid seals to separate lower fluid cavity 4 from upper fluid cavity 8.

Upper and lower ports 14 and 15 are provided for the intake and exhaust of air into and out of upper an lower air cavities 10 and 11. An appropriate seal 12 is provided for air piston 6 to separate upper and lower air cavities 10 and 11. The upper end of pump body 2 is closed by means of cap member 13 which contains the upper port 14.

The air for the operation of air piston 6 is controlled by the operation of upper and lower solenoids 16 and 17, respectively. These solenoids are attached to and operate upper and lower air valves 16*a* and 17*a*, respectively. Switch member 18, in the form of a conductive spring, is mounted in the upper air cavity 10 at the uppermost portion of the stroke of air piston 6. Switch member 18 is insulated from the walls of pump body 2 by means of insulator 19, and is connected by wire 20 to a latching relay for the operation of solenoid 16.

Switch member 21 is similarly mounted in lower air cavity 11 at the lowermost point of the stroke of air piston 6, and comprises a conductive spring insulated from the walls of pump body 2 by means of insulator 22. Switch member 21 is connected by wire 23 to a latching relay which controls solenoid 17.

The lower end of fluid piston 9 is equipped with a piston check valve 24 which has a stop pin 25. Fluid passes from the lower fluid cavity 4 through piston check valve 24 and into upper fluid cavity 8 through orifice 26.

Figure 5C:
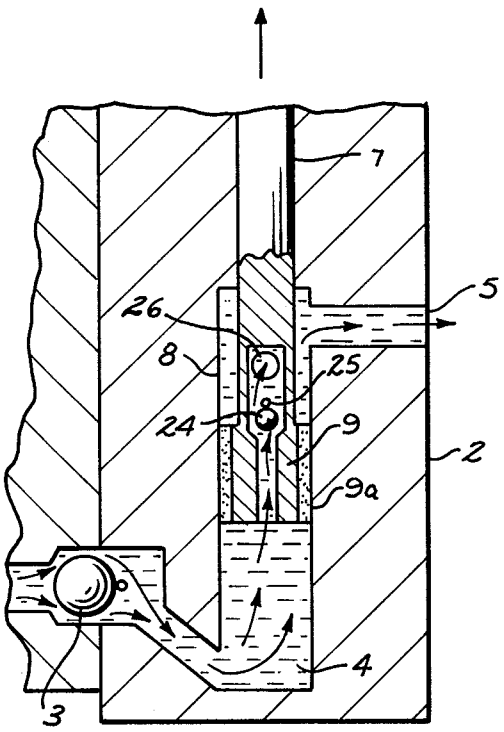
FIGS. 5*a*, 5*b* and 5*c* are cross-section detailed views of a portion of the structure shown in FIG. 1 depicting the relative positions of the component parts during different stages of operations.

The operation of the pump will be described with reference to FIGS. 1 and 2 which show the pump in its entirety and with reference to FIGS. 5*a*, 5*b* and 5*c* which show fluid piston 9 in various stages of operation.

FIG. 1 shows air piston 6 at the end of its donwstroke, and for the purposes of this description, it is assumed that the pump is empty and operation is to begin. As air piston 6 makes conductive contact with switch member 21, the electrical switch circuit is completed and solenoid 17 is energized. Lower air valve 17*a* operates to introduce air through port 15 into lower air cavity 11 and force air piston 6 upwardly. At the same time upper air valve 16*a* is open allowing the air in upper air cavity 10 to exhaust through port 14.

When air piston 6 reaches the end portion of its upward stroke the piston 6 contacts the conductive spring of switch kmember 18 thereby completing the electrical circuit to upper solenoid 16. Solenoid 16 actuates upper air valve 16*a* causing air to be applied to the upper face of piston 6 forcing it downwardly. When piston 6 again contacts lower switch member 21, the process is repeated.

The operation of the fluid section of the pump will now be discussed with reference to FIGS. 5*a*, 5*b* and 5*c*. As fluid piston 9 moves upwardly, check valve 24 is closed and a suction or reduced pressure is created in lower fluid cavity 4. Check valve 3 is forced open by the pressure of fluid during the upstroke of fluid piston 9, as shown in FIG. 5*a*.

Figure 5B:
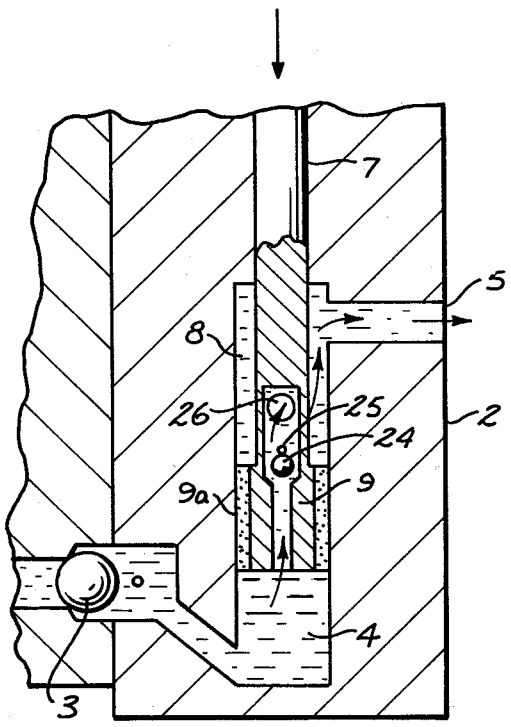
Figure 5A:
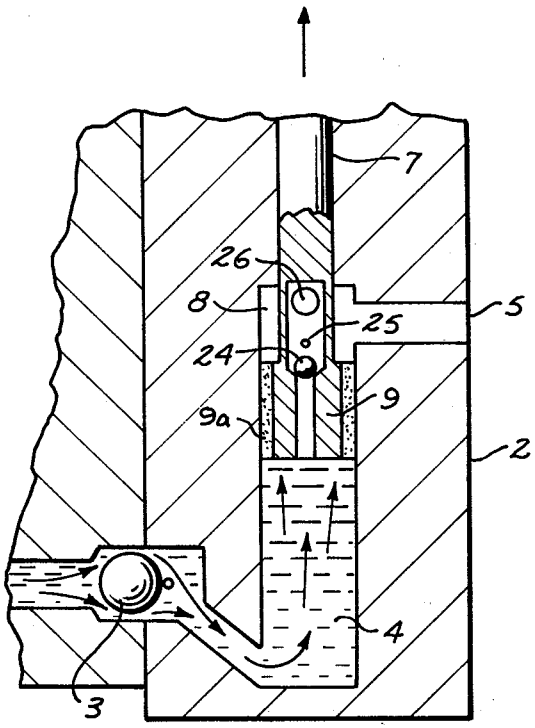

In FIG. 5*b* the fluid piston is on its downward stroke approaching the lower extreme of travel. Check valve 3 has been forced closed, and piston check valve 24 has been forced open. The fluid in lower cavity 4 is now forced upwardly and through check valve 24 into upper fluid cavity 8 through orifice 26 and out of the pump body through port 5. During this downward stroke of the piston 9, for any given amount of travel the volume swept will be greater in the lower cavity 4 than in the upper cavity 8, thereby causing the fluid to be forced from lower cavity 4 to upper cavity 8 and out of port 5.

FIG. 5*c* shows the piston 9 moving upwardly on a subsequent stroke. The fluid is again drawn into lower fluid cavity 4 as check valve 3 is open and check valve 24 within piston 9 is closed. Since the upper cavity 8 had been filled during the previous downward stroke, on this upstroke, fluid is similarly forced out of port 5.

Figure 4A:
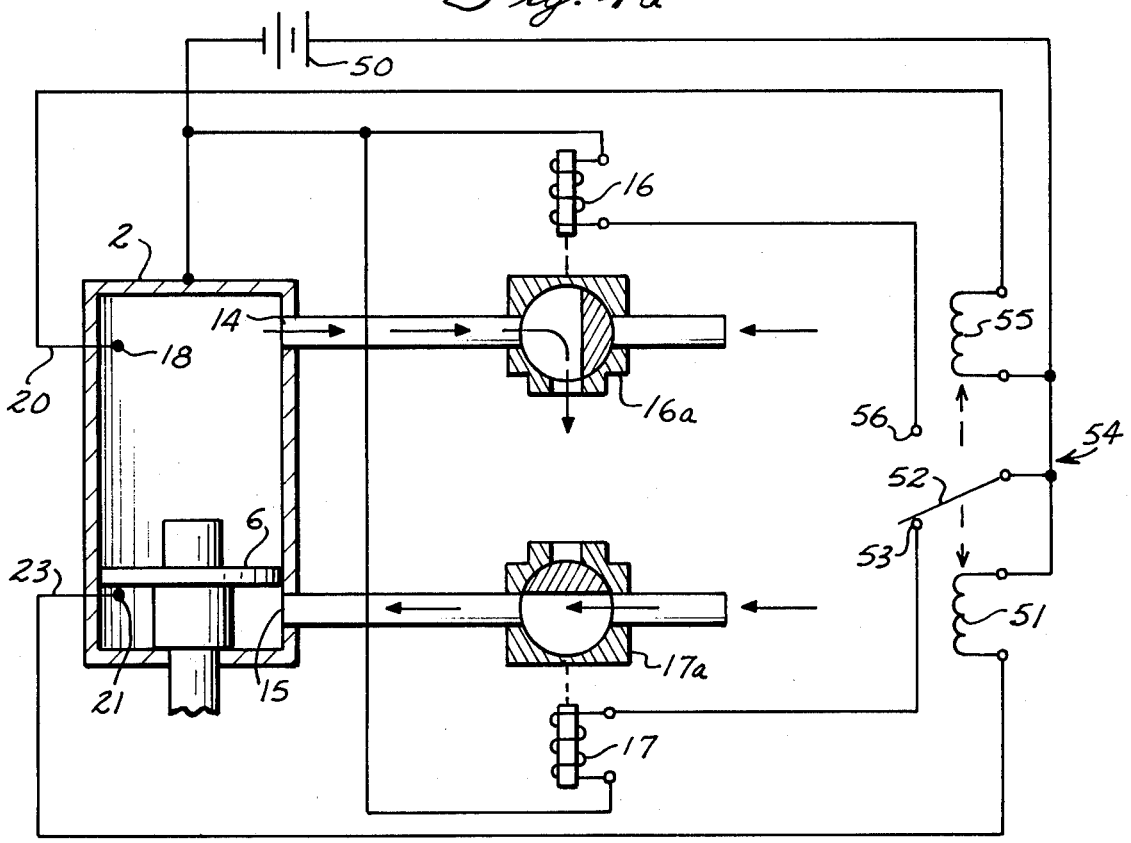
FIG. 4*a* is a diagrammatic view of the pneumatic and electrical control circuitry utilized in the system of FIGS. 1 and 2.

The operation of the solenoids and air valves will be understood more completely by referring to FIG. 4*a* which is a diagrammatic showing of the circuitry utilized in operation. Switch members 18 and 21 are connected to actuating coils 55 and 51 of a latching relay 54. Latching relay 54 has a movable contact 52 which is electrically connected either to fixed contact 53 or fixed contact 56 depending upon whether coil 51 or coil 55 has been previously energized. A battery or other source of electrical energy 50 provides the electromotive force for the operation of the circuitry.

When air piston 6 makes contact with lower switch member 12, the circuit is completed through lower coil 51 of latching relay 54 and movable contact 52 is drawn into connection with fixed contact 53. Electrical power is then supplied through solenoid 17 to actuate lower air valve 17*a* and provide for air to be introduced into lower air cavity 11 and force air piston 6 upwardly.

When movable contact 52 of latching relay 54 is drawn downwardly out of contact with fixed contact 56, solenoid 16 is de-energized, and upper valve 16*a* which is normally biased to the exhaust position, returns to that position so that air is exhausted from upper air cavity 10. Simiarly, when lower solenoid 17 is de-energized by the moving of contact 52 upwardly to make contact with fixed contact 56, lower air valve 17*a* returns to its exhaust position as solenoid 17 is de-energized.

The electrical control operation described herein provides distinct advantages for systems in which the fluid supply is fed to a gun or actuated head in which the opening and closing of a valve controls the flow of adhesive. In toggle-type mechanisms there is no way accurately to stop the movement of the air piston and thus the dispensing of the fluid adhesive. In the past control has been attempted by merely shutting off the air inlet to the toggle-mechanism with the assumption that the flow of adhesive will also be shut off, but this has never proven to be satisfactory. An alternate arrangement of circuitry shown in FIG. 4*b* can utilize an additional signal to completely block air into both sides of the air piston thus providing a means of immediately stopping the travel of the air piston to any intermediate point.

Figure 4B:
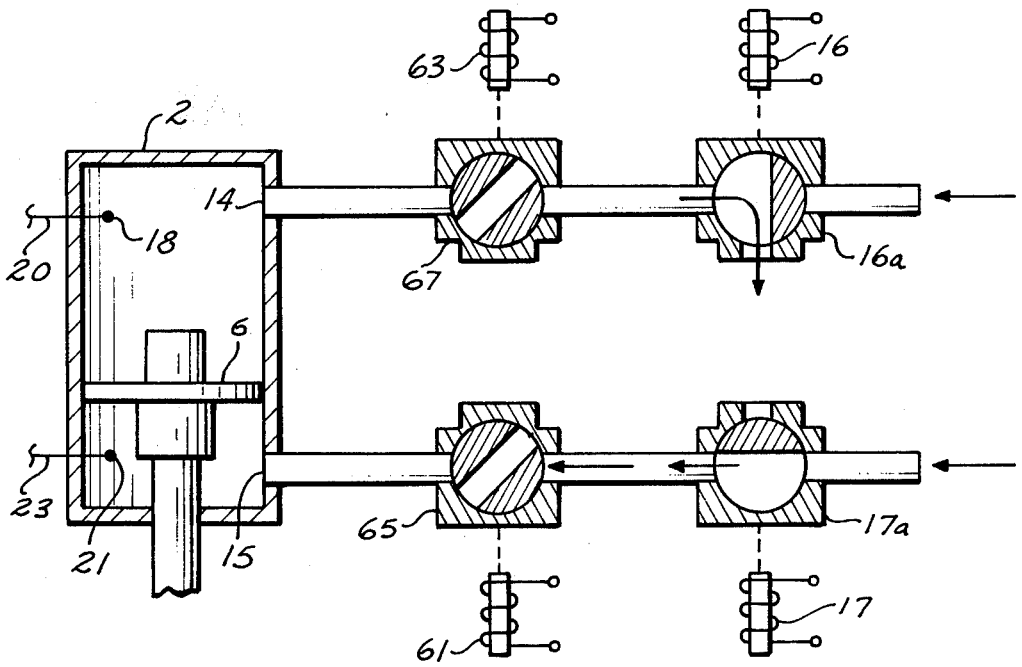
FIG. 4*b* is a diagrammatic view of an alternate arrangement of pneumatic and electrical control circuitry.

In FIG. 4*b* two additional solenoids 61 and 63 are shown controlling air shut off valves 65 and 67. Valves 65 and 67 are either open to allow air in either direction through the valve, or closed to block flow through the valve. When the pump is running and it is required to stop the flow of fluid material, the closing of valves 65 and 67 will immediately shut off all air flow to air piston 6 and will also prevent the escape of any air. This means that the travel of piston 6 will be immediately blocked. As soon as valves 65 and 67 are open, normal operation of air piston 6 will again continue.

One typical use of the arrangement shown in FIG. 4*b* would be in providing a flow of viscous material to a set of nozzles or header. Instead of closing each nozzle individually, stopping the movement of air piston 6 would, in effect, accomplish results similar to that of closing the individual nozzles.

It will be appreciated that the solenoid valves of the present system can accomplish reversal much faster than any conventional toggle-type mechanism. An ordinary solenoid valve can be reversed in approximately 20 milliseconds. The rapid action of the solenoid means that the valve is either fully open or fully closed, whereas toggle-type mechanisms have a comparatively lengthy period of changeover.

Figure 3A:
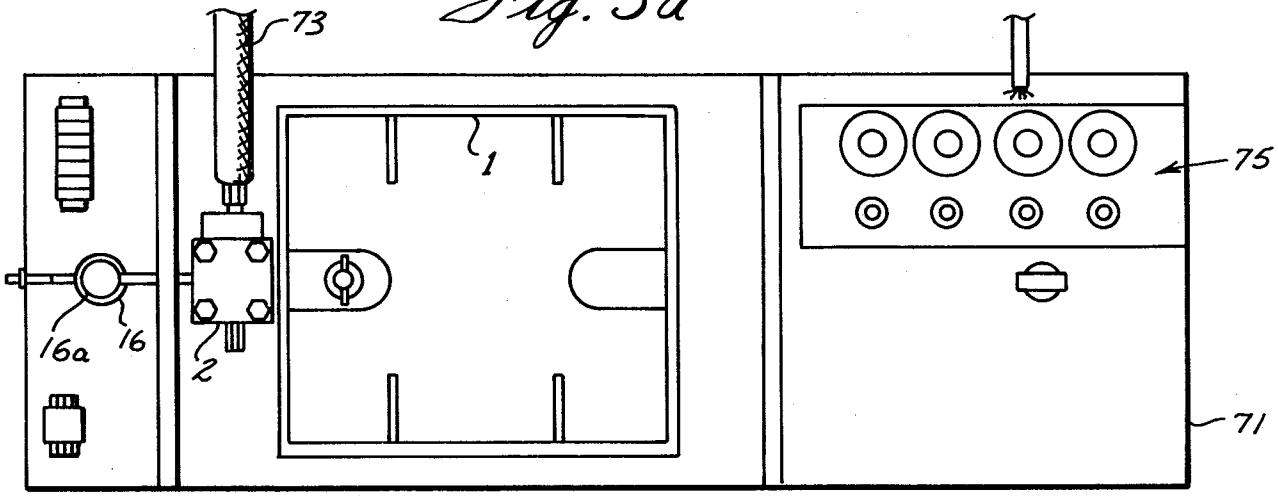
FIG. 3*a* and 3*b* are top and end views, respectively of the system console.
Figure 3B:
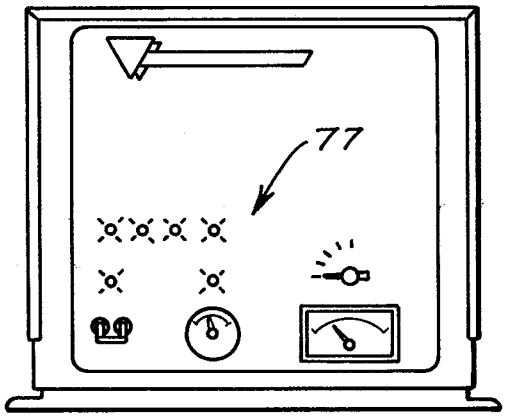

The system of the present invention provides a complete pumping system which is shorter in overall physical length than any other presently used pump of comparable pressure and capacity. The operation of the pump is simple and easily maintained by relatively unskilled personel, and the compact size permits mounting vertically in an enclosure without protrusion. FIGS. 3*a* and 3*b* illustrate the compact console enclosure 71 with externally heated hose 73 for supplying the hot-melt fluid. Various controls for gun and hose temperatures are shown generally at 75. Indicator lights and switches are shown generally at 77.

What is claimed is:

1. A reversible pump comprising a pump housing, a first fluid cavity within said pump housing containing a reciprocable piston dividing said first cavity into first and second portions, first and second port means in said first and second portions, respectively, for the inlet and outlet of fluid, first and second fluid lines connected to said first and second port means, respectively, first and second switch means mounted in said first and second fluid lines, respectively, first and second switch means mounted in said first and second first fluid cavity portions, said first and second switch means being positioned within their respective cavity portions to be actuated by said piston at each end of the reciprocating path, control means connected to said solenoid valves and said switch means for reversing the direction of fluid flow and piston travel as the piston reaches each end of its reciprocating path, said control means comprising a latching relay actuated by signals from said first and second switch means, third and fourth solenoid valves connected in said first and second fluid lines to shut-off simultaneously and completely block fluid flow to and from said reciprocable piston, a second fluid cavity within said pump housing having an inlet and an outlet port, a first check valve in said inlet port to block said inlet port during the pressure stroke, a double-acting, fluid piston connected to said reciprocable piston and forming a portion of said second fluid cavity, and a second check valve in said fluid piston to block off said second fluid cavity from said outlet port during the suction stroke, whereby reciprocating movement of said reciprocable piston causes said fluid piston to produce a pumping action to draw fluid into said second fluid cavity through said outlet port.

* * * * *